US005246351A

United States Patent [19]

Horn et al.

[11] Patent Number: 5,246,351

[45] Date of Patent: Sep. 21, 1993

[54] HYDRAULICALLY DRIVEN DIAPHRAGM PUMP WITH DIAPHRAGM STROKE LIMITATION

[75] Inventors: Waldemar Horn; Roland Hessenberger, both of Leonberg, Fed. Rep. of Germany

[73] Assignee: Lews Herbert Ott GmbH & Co., Fed. Rep. of Germany

[21] Appl. No.: 982,831

[22] Filed: Nov. 30, 1992

[30] Foreign Application Priority Data

Dec. 17, 1991 [DE] Fed. Rep. of Germany ..... 4141670

[51] Int. Cl.[5] ..... F04B 9/08; F04B 35/02

[52] U.S. Cl. ..... 417/387; 417/388; 417/395

[58] Field of Search ..... 417/386, 387, 388, 395; 60/592

[56] References Cited

U.S. PATENT DOCUMENTS

| | | | |
|---|---|---|---|
| 4,068,982 | 1/1978 | Quarve | 417/387 |
| 4,184,809 | 1/1980 | Kelley | 417/388 |
| 4,188,170 | 2/1980 | Ito | 417/387 |
| 4,365,745 | 12/1982 | Beck | 417/387 |
| 4,416,599 | 11/1983 | De Longchamp | 417/386 |
| 4,467,605 | 8/1984 | Smith | 60/592 |
| 4,883,412 | 11/1989 | Malizard et al. | 417/387 |
| 5,163,820 | 11/1992 | Karliner | 417/388 |

*Primary Examiner*—Richard A. Bertsch
*Assistant Examiner*—Alfred Basichas
*Attorney, Agent, or Firm*—Bierman and Muserlian

[57] ABSTRACT

In a hydraulically driven diaphragm pump, which is provided with a diaphragm clamped on the edge which separates a delivery chamber from a hydraulic chamber, the hydraulic chamber being subdivided into a diaphragm work chamber and a piston work chamber connected therewith via at least one connecting duct, a hydraulic diaphragm drive in the form of an oscillating displacement piston which is displaceable in the pump body between a reservoir for the hydraulic fluid and the piston work chamber, and with a diaphragm position-controlled leakage makeup device which comprises a control valve with a control slide displaceably guided in the zone of the connecting duct between diaphragm work chamber and piston work chamber, which slide opens—in the suction stroke end position of the diaphragm—a connection from the reservoir to the piston work chamber, the arrangement is made in such a way that the control slide (19) of the leakage makeup device is provided at its two ends with devices (31; 20) for stroke path limitation of the diaphragm (1) clamped freely swinging. For this purpose the control slide (19) has at its diaphragm-side end a support plate (31) which together with the associated pump body face (10) of the diaphragm work chamber (9) forms a virtually gap-free mechanical support face (10, 10', 10'') adapted to the natural diaphragm geometry, for the diaphragm in the suction stroke end position thereof. As distinguished therefrom the control slide (19) has at its piston-side end a second control valve (20) with a valve element (21) which in the pressure stroke end position of the diaphragm (1) interrupts the hydraulic connection from the piston work chamber (5) to the diaphragm work chamber (9).

7 Claims, 6 Drawing Sheets

HYDRAULICALLY DRIVEN DIAPHRAGM PUMP WITH DIAPHRAGM STROKE LIMITATION

Figure 1:
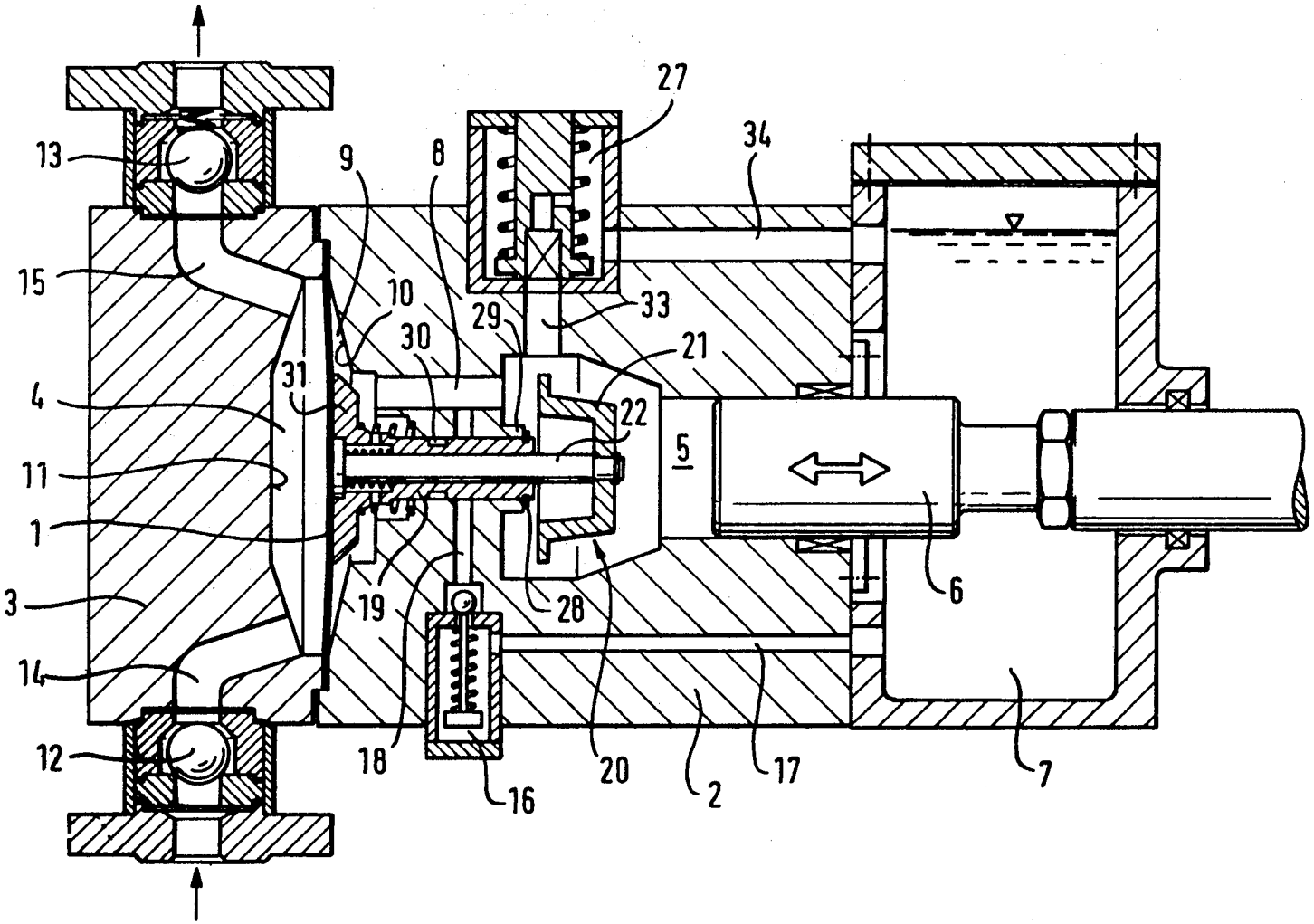

The invention relates to a hydraulically driven diaphragm pump according to the preamble of claim 1.

In a known diaphragm pump of the species (DE-PS 23 33 876), which has a hydraulic diaphragm drive and is realized with a so-called free-swinging diaphragm, in particular a plastic diaphragm, a diaphragm position-controlled leakage makeup device is provided.

Due to the arrangement of a free-swinging diaphragm, a mechanical limitation of the diaphragm stroke in the direction of the delivery chamber, for example by means of a perforated plate, is unnecessary. This makes possible the formation of a free, undisturbed delivery chamber, affording the user a number of advantages. Thus, only small flow losses result in the delivery chamber, which is advantageous at high viscosity of the pumped fluid. Further, a delivery chamber thus designed is well suited for conveying coarse-grained and fibrous suspensions. Also, such a delivery chamber is easy to clean. This is of importance when the diaphragm pump is to be used in the food sector.

The non-existing mechanical support of the diaphragm in the delivery chamber, however, requires suitable structural measures to be taken in the hydraulic chamber, to prevent overexpansion of the diaphragm during the pressure stroke in the direction of the delivery chamber.

With respect to the leakage makeup device provided in the known diaphragm pump, that of the diaphragm position-controlled type has found acceptance. This means that the diaphragm itself takes over the actuation of a control valve, where a diaphragm-controlled slide valve, which in the region of the connecting duct between diaphragm work chamber and piston work chamber is slidable, opens in the suction stroke position of the diaphragm a connection from the reservoir to the piston work chamber. Leakage makeup can and should occur only when the diaphragm has reached a predetermined limit position at the end of the suction stroke.

Additional design forms of such leakage makeup devices of diaphragm pumps are described in DE 28 43 054 and in FR 24 92 473.

Control of leakage makeup by the diaphragm position brings a number of other advantages as compared with the pressure-controlled leakage makeup with a sniffing valve. Thus, on the one hand, great suction heads can be overcome, the suction head being limited only by the vapor pressure of the flow medium and of the hydraulic fluid. On the other hand, overloads of the hydraulic chamber, as may occur with pressure-controlled leakage makeup due to vacuum peaks, are precluded. Such pronounced vacuum peaks occur preferably in large high-pressure diaphragm pumps at the beginning of the suction phase if the fluid column in the suction line is accelerated bruskly on opening the suction valve. Lastly the diaphragm position-controlled leakage makeup makes possible the sniffing in of hydraulic fluid at a small differential pressure of, for example, less than 0.3 bar, that is, the absolute pressure remains at about 0.7 bar. Thereby gas formation in the hydraulic chamber can be avoided to a large extent, resulting in corresponding advantages with regard to delivery output and precision. By contrast, the pressure-controlled leakage makeup requires a relatively high setting of the differential pressure at the sniffing valve of for example 0.6 bar to ensure reliable operation. The pressure reduction caused thereby in the hydraulic chamber during the sniffing process to for example 0.4 bar absolute pressure leads to increased gas formation. The consequence of this is reduced delivery output and delivery precision.

In the practive it has been found, however, that the known diaphragm pumps of the type in question still have certain weaknesses, which it is desirable to eliminate. Thus, before the pump is taken into operation, care must be taken that in no case will the diaphragm be deflected out too far in the direction of the delivery chamber relative to the piston. Further, only a predetermined quantity of hydraulic fluid may be present in the hydraulic chamber, as too much hydraulic fluid would upon the first exerted pressure stroke of the piston lead to an overexpansion or even bursting of the diaphragm. If, on the other hand, too little hydraulic fluid is present, the missing quanity of fluid is automatically made up at the end of the first suction stroke by means of the leakage makeup device.

Manual positioning of the diaphragm before starting the pump is relatively costly. It is normally performed by creating a connection between hydraulic chamber and reserve chamber, which is done for example by removing the pressure limiting valve. The diaphragm is then pushed in the direction for driving it by applying positive pressure on the suction side of the pump, which accordingly exerts pressure also on the delivery chamber-side diaphragm face. When the diaphragm then moves in the direction of its drive, hydraulic fluid is simultaneously displaced from the hydraulic chamber into the reservoir.

This separately performed diaphragm positioning must be repeated also after prolonged standstill of the pump, to eliminate the risk that, as is normally to be expected, the diaphragm has moved toward the pump cover during the stoppage. Such—undesirable—diaphragm shifting must be reckoned with whenever a vacuum prevails at the suction valve or pressure valve of the delivery chamber during the stoppage. The vacuum prevailing for example at the suction valve can propagate via the statically never quite hermetic suction valve into the delivery chamber as well as into the hydraulic chamber and then leads to hydraulic fluid being drawn, e.g. via the piston seal, from the reservoir into the hydraulic chamber.

The costly, but necessary, starting of the diaphragm pump as described is especially disadvantageous for modern triple diaphragm pumps, where the initial diaphragm positioning must be done at three pump heads. This diaphragm positioning can indeed be simplified by solenoid valves installed between hydraulic chamber and reservoir. Still, the expense for construction and control remains considerable in any case. Also, it is not always easy to make available the necessary pressure on the suction side of the pump for pushing the diaphragm in the direction of its drive.

Starting from this state of the art, it is the object of the invention to design the diaphragm pump of the species in such a way that the diaphragm stroke is limited in both directions in a functionally reliable manner with simple means, and that starting of the pump can be carried out without manual preparations for acting on the diaphragm position.

The features of the invention made for solving this problem are evident from claim 1. Advantageous developments thereof are described in the other claims.

The invention is based on the idea of placing the devices for limiting the diaphragm stroke in both directions on the slide valve—present anyway—of the leakage makeup device. This results in an amazingly simple, yet functionally reliable design. At the same time it is ensured that the pump can be taken into operation without having to carry out manual preparations for the purpose of acting on the diaphragm position.

With respect to limiting the diaphragm movement in both stroke directions, the diaphragm pump according to the invention makes use of a dual or combined principle. This principle consists in that, on the one hand, the diaphragm stroke limitation in the suction stroke end position occurs purely mechanically, namely by means of the virtually gap-free support face that is formed by a support plate and associated pump body face and that is adapted to the natural diaphragm geometry, while on the other hand the diaphragm stroke limitation is brought about purely hydraulically in the pressure stroke limit position, in that the valve member disposed at the piston-side end of the slide valve interrupts the hydraulic connection from the piston work chamber to the diaphragm work chamber. In the last-named case, excess hydraulic oil is then displaced via the pressure limiting valve into the hydraulic reservoir.

With the invention, therefore, the principle is carried into effect that on the basis of the diaphragm position-controlled leakage makeup, achieved with the slide valve, a diaphragm position-controlled movement or stroke limitation of the diaphragm in the direction of both pressure stroke and suction stroke is brought about. Here, as has been stated before, there occurs in the suction stroke end postion of the diaphragm a completely mechanical support of the diaphragm by means of a virtually gap-free mechanical support face. The latter is formed by the correspondingly formed support plate disposed at the diaphragm-side end of the slide valve in conjunction with the associated pump body face of the diaphragm work chamber.

In this connection, as an advantageous variant, it may be provided that the mechanical support face is designed bore-free, this proving to be especially advantageous when using the invention for high-pressure diaphragm pumps.

Appropriately the second control valve, by means of which the hydraulic limitation of the diaphragm stroke in the pressure stroke end position or limit position is brought about, is designed as a disk valve, whose disk closes the connecting duct or ductss in the pressure stroke end position, whether it be in the form of a disk, a bowl, or the like.

In an appropriate embodiment of the invention, the slide valve of the leakage makeup device, which has at its diaphragm-side end the support plate firmly connected therewith, may be designed so that also the valve member of the second control valve at the piston-side end is firmly connected therewith.

In a variant of the invention it is of advantage, however, if the valve member of the second control valve is fastened at one end of a valve stem, which in turn is guided slidably in the slide valve of the first control valve, coaxially thereto, and applies by its other end under spring force against the diaphragm, so that it senses the diaphragm over the entire diaphragm stroke.

In connection with such a design it is of advantage if the control slide of the first control valve is tensioned in the direction of the diaphragm by a spring which is stronger than the spring tensioning the valve stem of the second control valve. It is within the scope of the invention that the spring tensioning the stem of the second control valve is supported on the control slide itself.

Since in contrast to the valve stem of the second control valve it is not necessary for the control slide to follow the entire stroke path of the diaphragm, it is provided according to the invention that the control slide has at its piston-side end a stop which limits the displacement path of the control slide in the direction of the diaphragm pressure stroke. Thereby, when the diaphragm moves out of its suction stroke end position in the direction of the pressure stroke, the control slide follows the diaphragm only in a certain zone, which preferably amounts to 30–40% of the total diaphragm stroke. This means in other words that when the diaphragm returns from its pressure stroke end position to the suction stroke end position, the control slide is actuated by the diaphragm only on the last 30–40% of the suction stroke.

As stated before, in the form of realization in which the second control valve is separate from the first control valve, the valve stem, supported by the force of its spring, senses the diaphragm on the entire diaphragm stroke. The second control valve operates entirely independently from the first control valve, that is, it still senses the diaphragm even if the operation of the first control valve is impeded e.g. by dirt. During normal pump operation, when the diaphragm operates in its intended sphere, the valve stem idles along, as it were. But when the diaphragm goes outside the intended sphere of operation by a certain amount, preferably about 20% of the normal diaphragm stroke, in the direction of the delivery chamber, the valve disk closes the connecting duct or ducts between piston work chamber and diaphragm work chamber. Thereby the hydraulic connection is interrupted, so that the diaphragm cannot be deformed further toward the delivery chamber. Hence the diaphragm is secured against overexpansion. The excess hydraulic fluid present in the piston work chamber is pushed back into the hydraulic reservoir via the pressure limiting valve.

With the invention, therefore, not only is a desirable protection of the diaphragm obtained when the pump is taken into operation, but, due to the fully independent operation of the two control valves, an additional improvement of the safety of operation of the pump is achieved. This is of great importance if the first control valve malfunctions, for example due to dirt, and remains open, so that uncontrolled sniffing in of hydraulic fluid would be possible. In this case, however, the second control valve reliably prevents diaphragm damage, in that it prevents in the described manner a pressure stroke of the diaphragm beyond the normal end position. The excess hydraulic fluid is then sent back into the reservoir. The pump then simply operates at reduced output and the pressure-limiting valve responds.

The occurrence of diaphragm damage, reliably prevented by the invention, which would normally require replacement of flow medium and hydraulic fluid, is of special importance for the reason that such diaphragm damage entails considerable costs. They result from the fact that the entire process in which the respective diaphragm pump is integrated must be stopped immediately, that aggressive media get into the hydraulic chamber and will cause considerable corrosion damage there, and that the production batch, for example if the pump is used in the food sector, may be impaired or spoiled by the hydraulic fluid penetrating into the delivery chamber.

We can estimate the significance of the additional protection from diaphragm damage achieved by the invention when we realize that in one year of continuous operation the control slide valve of the leakage makeup device must follow the diaphragm approximately $10^8$ times, and even a single faulty control of the slide valve can lead to diaphragm damage.

Another advantage according to the invention derives from the design of the slide valve and of the valve stem displaceably guided therein. In fact, in the compressed position the end faces of these two control elements together with the associated pump body face form a virtually gap-free mechanical support face, which is adapted to the natural diaphragm form. Only extremely small gaps exists, preferably 0.1 to 0.2 mm wide as a maximum, so that it can rightly be said that the support face is almost completely gap-free. The diaphragm is mechanically supported in its suction stroke end position by this bearing face and can be applied with the full delivery pressure without suffering any damage.

This is of special importance for the reason that in the practice the following cases occur, which however are mastered with certainty due to the arrangement according to the invention.

The pump is supplied from a pressure system. Thus the admission pressure pushes the diaphragm against the bearing face each time at the end of the suction stroke, i.e. during the sniffing phase that brings about the leakage makeup;

During standstill of the pump, the suction-side admission pressure acts continuously on the diaphragm. Due to the always existing leakage at the piston seal, the diaphragm places itself against the bearing face after a short time;

during standstill of the pump, if the pressure valve of the delivery chamber leaks slightly, the full delivery pressure can then act on the diaphragm, e.g. from a reactor. Thereby, also, the diaphragm applies against the support face during standstill of the pump.

In all, therefore, significant advantages are achieved by the invention, inter alia to the effect that starting of the pump can be done without manual preparations and that the diaphragm deflection is automatically limited with simple means both in the pressure stroke and in the suction stroke. Thereby overexpansion or even bursting of the diaphragm is prevented with certainty. For this reason the diaphragm pump can be integrated much more easily in automated processes, based on the fact, inter alia, that costly manual preparations, interfering with the process rundown, for acting on the diaphragm position, are obviated. Furthermore, the danger of diaphragm damage due to faulty operation is eliminated. Costly stoppages can be avoided.

Figure 2:
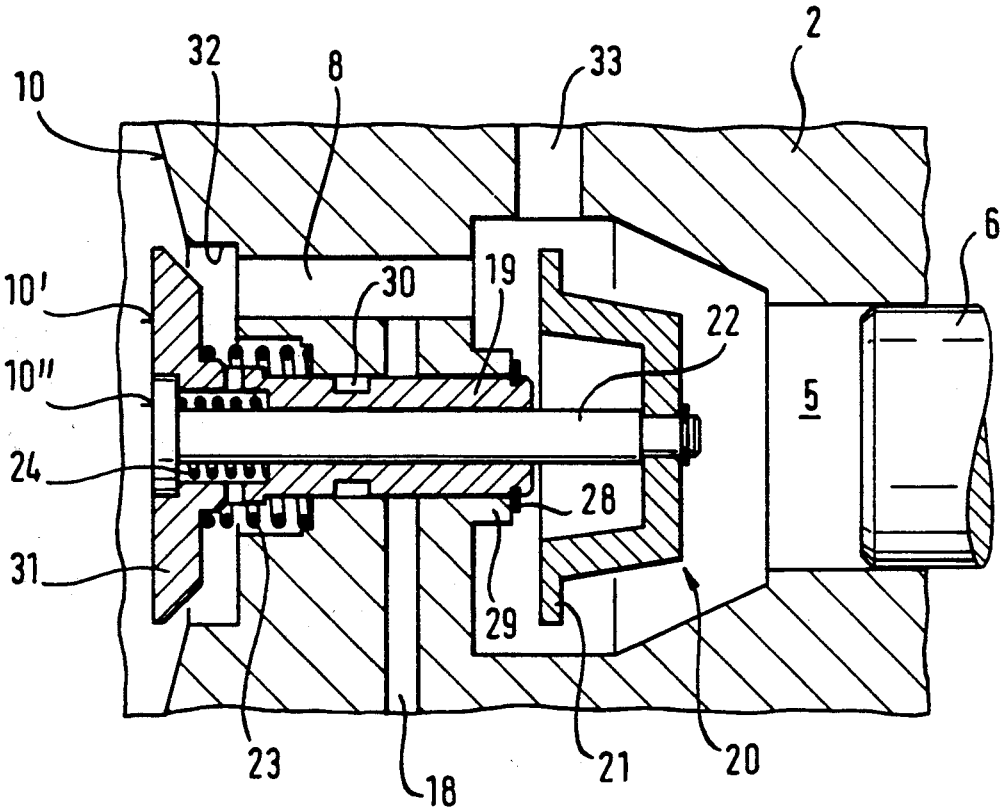
Figure 3:
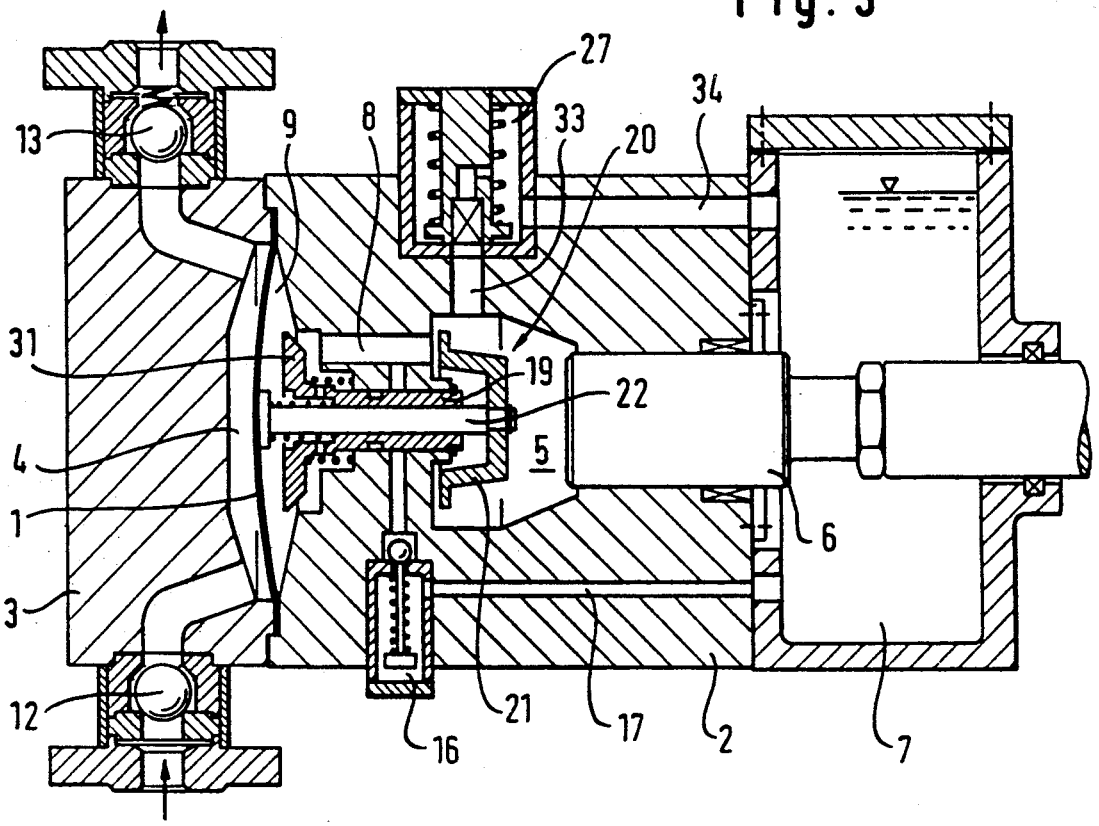
Figure 4:
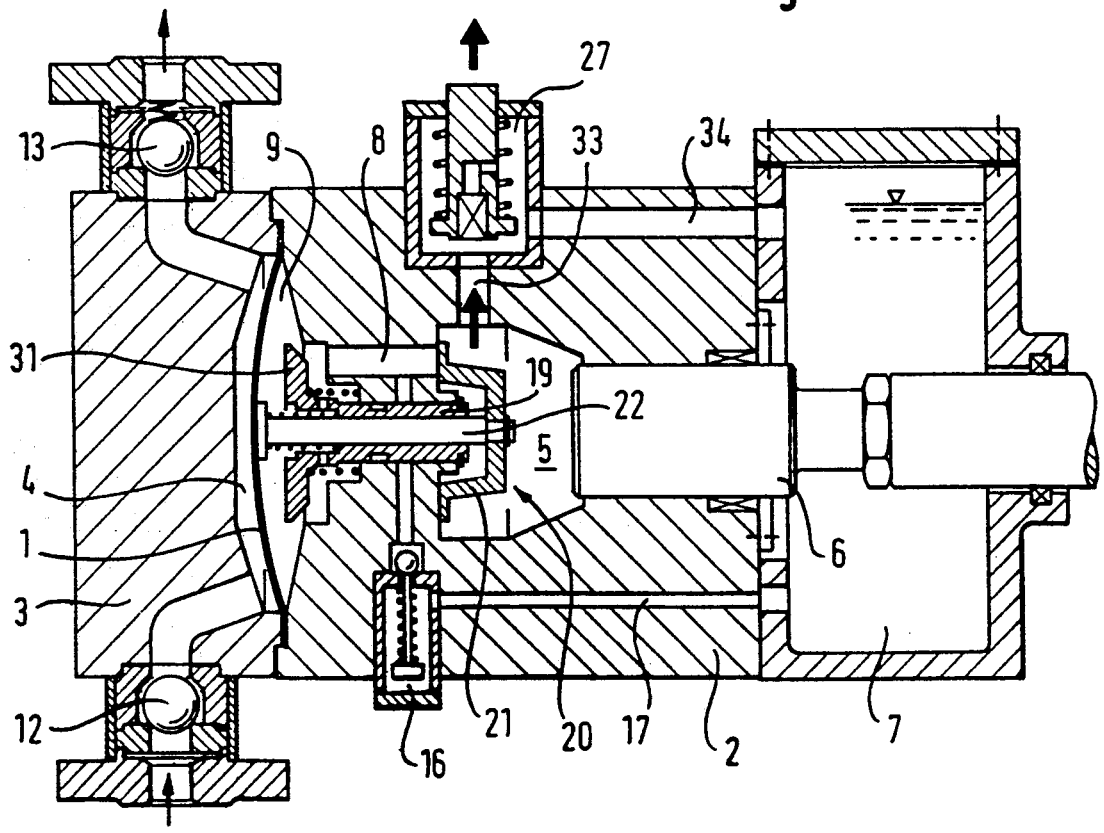
Figure 5:
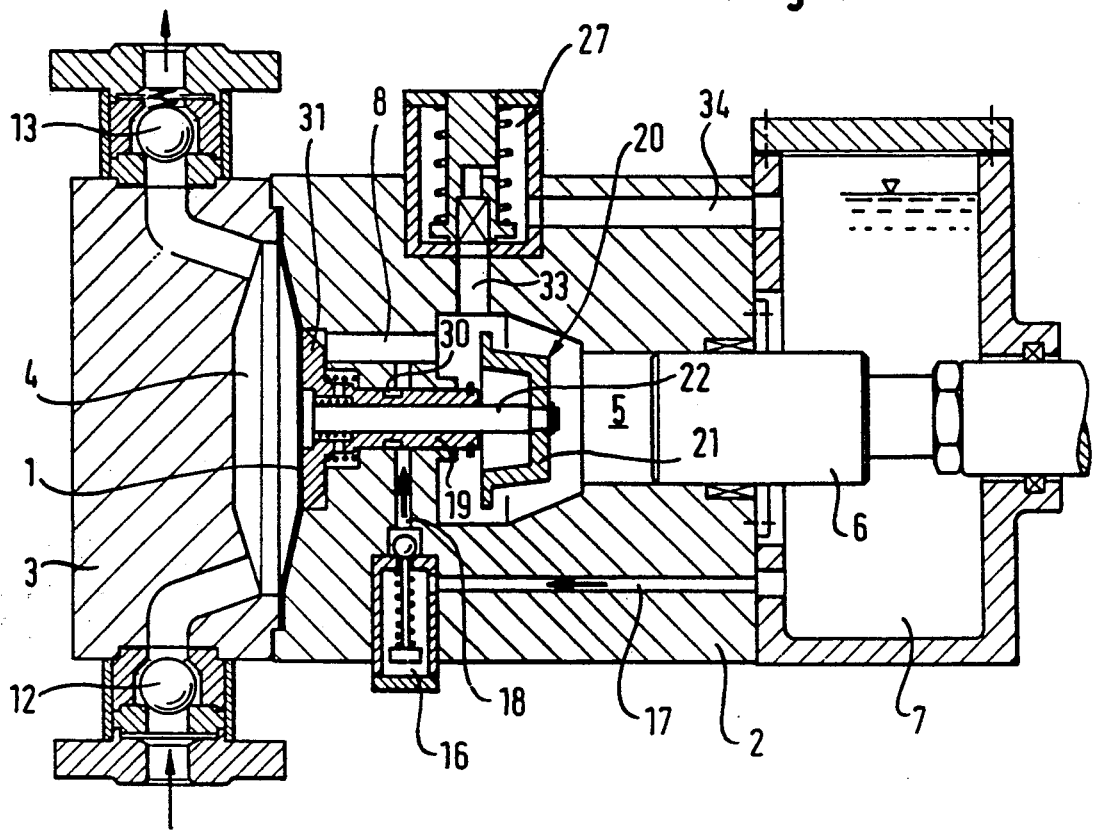
Figure 6:
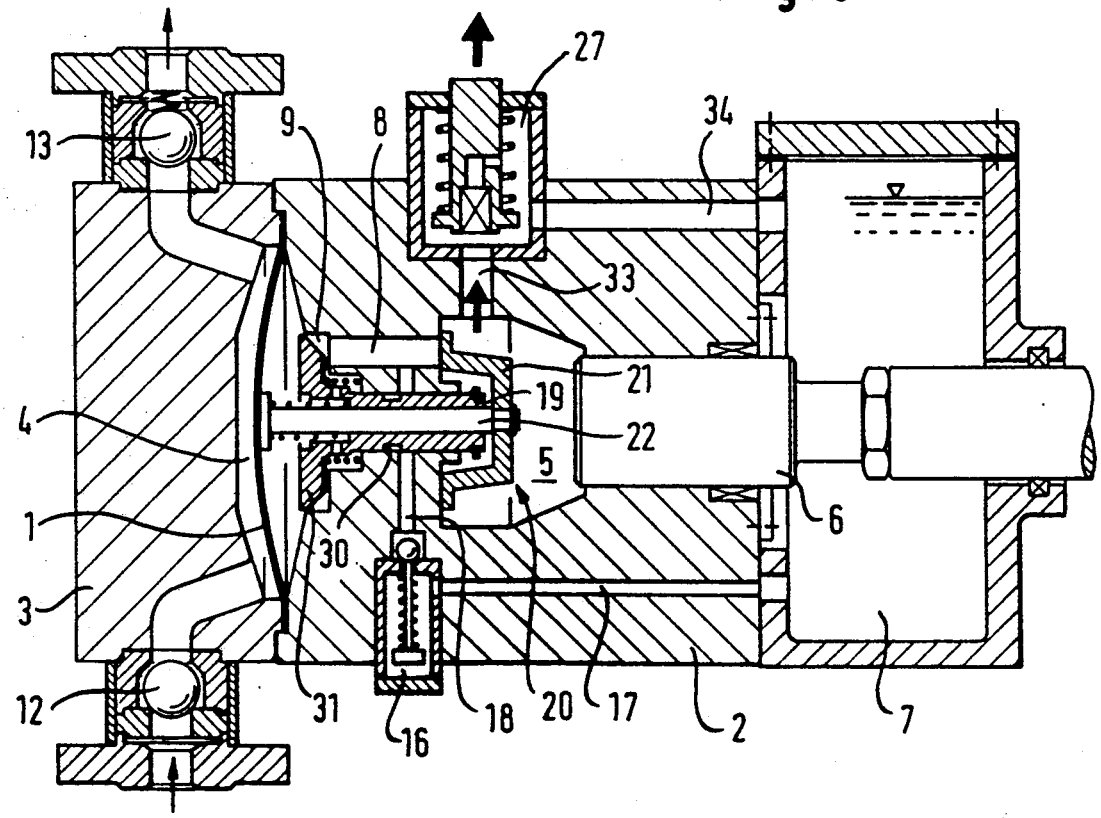
Figure 7:
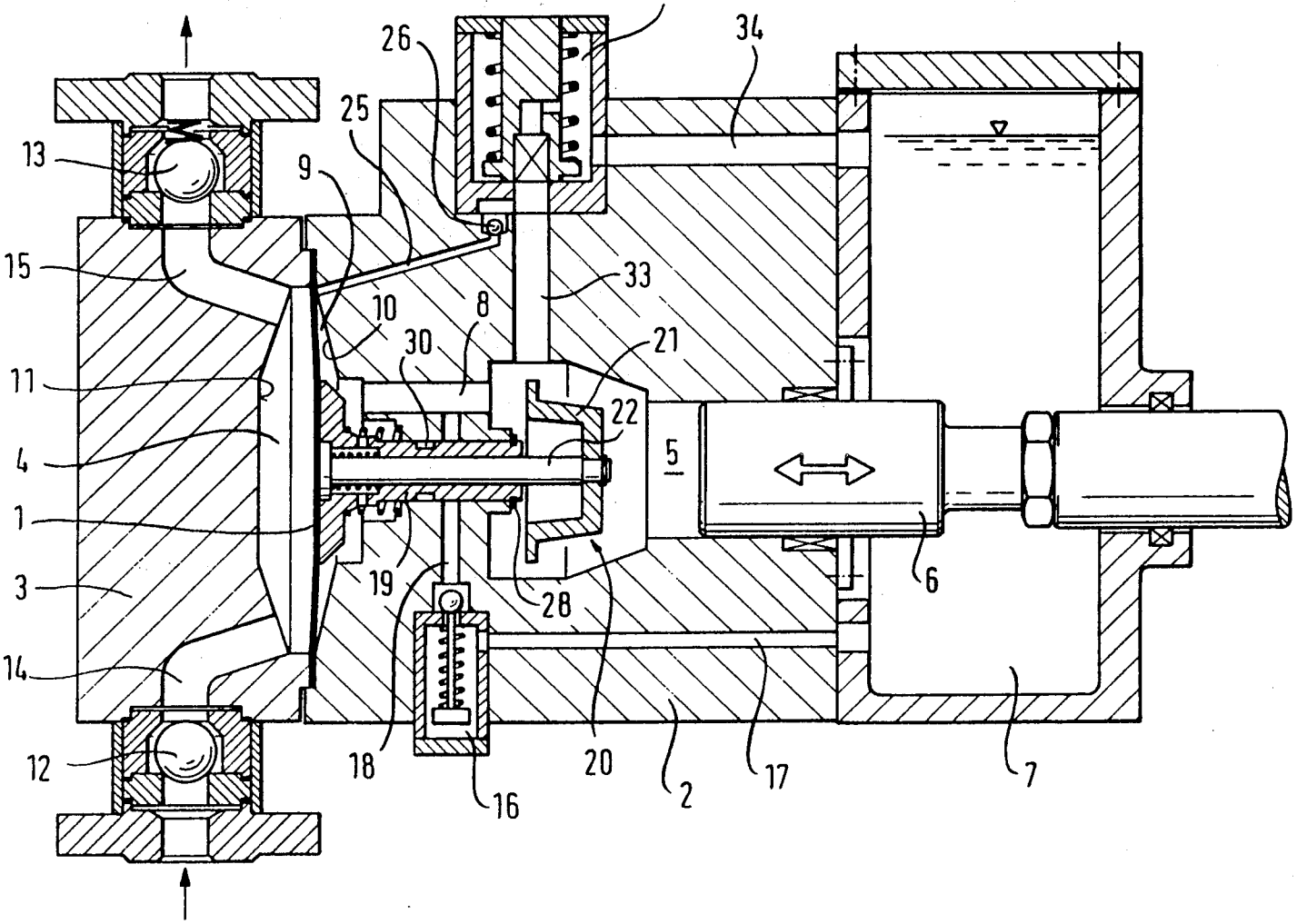
Figure 8:
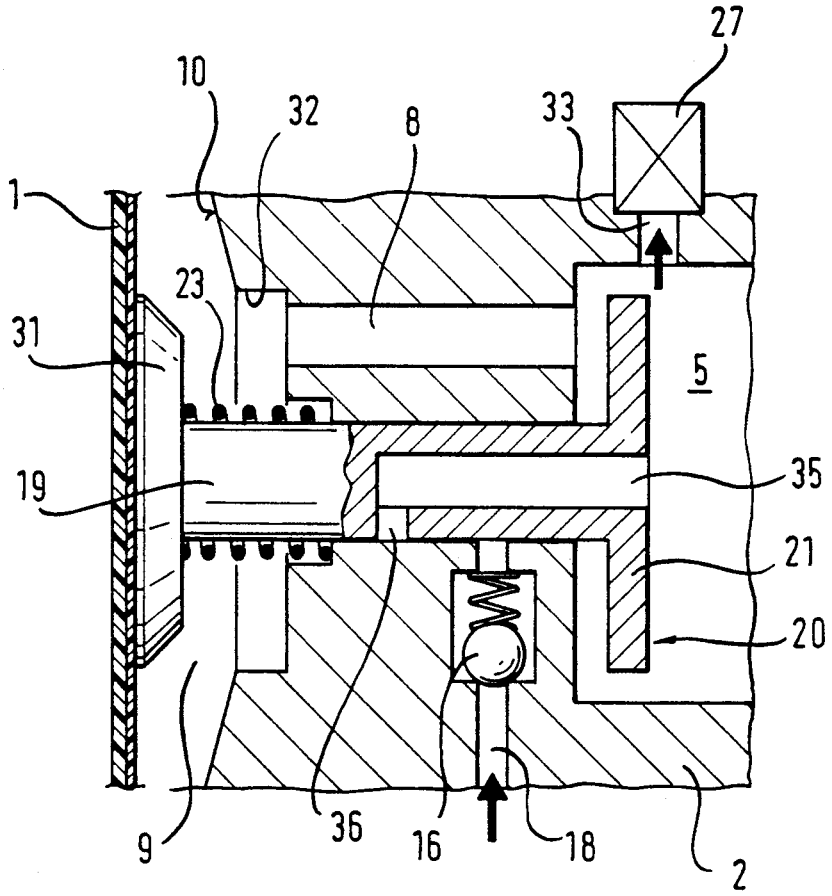

In the following, the invention will be explained more specifically in several embodiment examples with reference to the drawing, in which:

FIG. 1 shows schematically in transverse section a diaphragm pump according to the invention;

FIG. 2, on a larger scale, in detail, the diaphragm position-controlled leakage makeup device with the two devices for diaphragm stroke limitation;

FIG. 3, schematically in transverse section, the diaphragm pump with a diaphragm in the pressure stroke end position corresponding to a normal position;

FIG. 4, with a diaphragm in the pressure stroke end position corresponding to a limit position, and FIG. 5, with a diaphragm which is in the suction stroke end position and applies against the support face;

FIG. 6, the diaphragm pump in a malfunctioning state in which the slide valve jams and the leakage makeup connection between sniffing valve and hydraulic chamber is permanently open;

FIG. 7, a modified form of the diaphragm pump with a venting bore communicating with the diaphragm work chamber; and FIG. 8, enlarged and in detail, a further modified-simplified-form of the diaphragm pump in which the first and second control valves are in one piece or firmly joined together.

As can be seen from the first form of realization shown in FIGS. 1 to 6 of the drawing, the diaphragm pump has a conventional diaphragm 1, in particular of plastic. The diaphragm is clamped at its edge between a pump body 2 and a pump cover 3 detachably fixed thereto on the end face, separating a delivery chamber 4 from a hydraulic fluid-filled pressure chamber which constitutes the piston work chamber.

The diaphragm pump has a hydraulic diaphragm drive in the form of an oscillating displacement piston 6, which is adapted to slide in the pump body 2 sealed between the piston work chamber 5 and a reservoir 7 for the hydraulic fluid. The piston work chamber 5 communicates, via at least one axial bore 8 in the pump body 2, with a diaphragm-side pressure chamber 9, which constitutes the diaphragm work chamber and and forms together with the piston work chamber 8 the hydraulic chamber as a whole. As can be seen, the diaphragm work chamber 9 is limited on the one hand by the diaphragm 1 and on the other hand by a rear (piston-side) cap 10. This rear limiting cap 10 is formed by the matching end face of the pump body 2 and constitutes a part of the mechanical support face—still to be described—against which the diaphragm 1 applies at the end of the suction stroke (see FIG. 5).

In mirror symmetry to the piston-side limiting cap 10 there is formed in the delivery chamber 4 a front limiting cap 11 formed by the end face of the pump cover 3. Cover 3 is provided in the usual manner with a spring-loaded inlet valve 12 (suction valve) as well as with a spring-loaded outlet valve 13 (pressure valve). These two valves 12, 13 communicate via an inlet duct 14 and via an outlet duct 15 with the delivery chamber 4 in such a way that during the suction stroke of the displacement piston 6, going to the right in FIG. 1, and hence of the diaphragm 1, the flow medium is drawn in arrow direction into the delivery chamber 4 via suction valve 12 and inlet duct 14. On the other hand, during the pressure stroke of diaphragm 1 going to the left in FIG. 1, the flow medium is then discharged dosagewise from the delivery chamber 4 via outlet duct 15 and pressure valve 13 in arrow direction.

To prevent cavitation at the end of the diaphragm suction stroke and to take care of the leakage makeup required because of the leakage losses, a leakage makeup device is provided. It comprises the usual spring-loaded sniffing valve 16 which communicates via a duct 17 with the reservoir 7 and via a duct 18 and the connecting duct 8 on the one hand with the piston work chamber 5 and on the other hand with the diaphragm work chamber 9.

The leakage makeup is controlled by a first control valve which comprises a control slide 19. The latter is coaxial with the displacement piston 6, sliding in a corresponding bore of the pump body 2 in the region of the connecting duct 8 between diaphragm work chamber 9 and piston work chamber 5, and is under the action of a compression spring 23 (see FIG. 2). Spring 23 is braced in the pump body 1 and at the diaphragm-side end of slide valve 19, so that slide valve 19 is tensioned in the direction of diaphragm 1 and follows the movement of diaphragm 1 from the suction stroke end position in pressure stroke direction. This follow-up movement, however, takes place only over a zone which amounts for example to 30–40% of the initial diaphragm pressure stroke, as slide valve 19 has at its piston-side end a stop 28—for example in the form of a circlip lock ring—which cooperates with a corresponding collar 29 in the piston work chamber 5 and limits the displacement of slide valve 19 in the direction of the diaphragm pressure stroke.

At a certain point of the circumference of slide valve 19 a peripheral groove 30 is provided, which in the suction stroke end position of diaphragm 1 (FIG. 5) establishes the connection between the sniffing valve 16 of the leakage makeup device and the hydraulic chamber 5, 9—via the ducts 18, 8.

At the piston-side end of slide valve 19 a second control valve 20 is provided. As can be seen clearly from FIG. 2, it is designed as a disk valve and has a cupped disk 21, a stem 22 connected therewith, and a compression spring 24 which takes upport on slide valve 19 in the manner shown and tensions the second control valve 20 in the direction of diaphragm 1. The valve stem 22 is guided displaceable in slide valve 19, coaxial therewith and, due to the action of its compression spring 24, it always applies by its diaphragm-side end against the diaphragm 1, so that it senses diaphragm 1 on the entire diaphragm stroke. The valve disk 21 is designed so that in the limit position of the diaphragm pressure stroke end position it closes the connecting duct or ducts 8 (FIG. 4).

The diaphragm-side end of slide valve 19 is designed as a support plate 31. It is shaped so that its end face 10′ together with the associated end face 10 of pump body 2 and the end face 10″ of the diaphragm-side end of valve stem 22 forms a virtually gap-free mechanical supporting face for diaphragm 1 in the suction stroke end position thereof. This supporting face 10, 10′, 10″ is adapted to the natural diaphragm geometry, it being of special importance that it is made completely bore-free.

In the compressed position of slide valve 19, the support plate 31 is received in a corresponding bore 32 of the pump housing 2; it is, however, not necessary for the support plate 31 to apply tightly against the seat formed by bore 32. It suffices to ensure that by all of the mentioned end faces 10, 10′, 10″ the described mechanical support face for diaphragm 1 is formed in the suction stroke end position thereof.

With regard to the two compression springs 23, 24 which tension the slide valve 19 or respectively the valve stem 22 in the direction of diaphragm 1 it should be stated also that spring 24 bracing valve stem 22 at slide valve 19 is weaker than spring 23 bracing slide valve 19 at the pump housing 2.

As can be seen from the drawing, the pump body 2 lastly contains also a pressure-limiting valve 27 which communicates on the one hand via a duct 33 with the piston work chamber 5 and on the other hand via a duct 34 with the hydraulic reservoir 7. Owing to this, when valve disk 21 has closed the connecting ducts 8 between piston work chamber 5 and diaphragm work chamber 9 in the case of the diaphragm 1 being in pressure stroke limit position, excess hydraulic fluid can be forced out of piston work chamber 5 via the pressure-limiting valve 27 into reservoir 7.

When the described diaphragm pump is taken into operation from an inactive state, for example after a stoppage, and therefore its relevant structural parts are in the position per FIGS. 1 or 2, the displacement piston 6 is moved to the right, to execute the suction stroke. Diaphragm 1 then applies in the suction stroke end position, as is evident from FIG. 5, against the mechanical support face 10, 10′, 10″ formed by the end faces of pump body 2, of support plate 31 and of the diaphragm-side end of valve stem 22. In this suction stroke end position of diaphragm 1, slide valve 19 with its diaphragm-side support plate 31 as well as the valve stem 22 are in the compressed position, in which said end faces 10, 10′, 10″ form the described support face adapted to the diaphragm form. Hence diaphragm 1 is supported in its suction stroke end position completely mechanically and can be pressed on with the full delivery pressure without suffering any damage.

In this position or respectively in the limit position going beyond it, also the peripheral groove 30 of slide valve 19 establishes the leakage makeup connection between hydraulic reservoir 7 and hydraulic chamber 5, 9, namely via duct 17, snuffing valve 16, duct 18, and the connecting duct or ducts 8.

If now the displacement piston 6 is moved to the left per FIG. 5 to execute the pressure stroke, also diaphragm 1 performs the pressure stroke due to the hydraulic medium acting on it in hydraulic chamber 5, 9, and into the pressure stroke end position per FIG. 3 representing the normal position. In so doing, slide valve 19 under the action of spring 23 follows the diaphragm 1 only over a distance amounting to about 30–40% of the total diaphragm pressure stroke, as then stop 28 of slide valve 19 strikes against the housing-side collar 29, thus limiting the movement path of slide valve 19.

By contrast, valve stem 22, tensioned by spring 24, senses the diaphragm 1 on the full pressure stroke thereof. In so doing, the valve stem 22 runs along idle as it were, as long as diaphragm 1 operates in its predetermined stroke zone. This means that in the normal pressure stroke end position of diaphragm 1 the valve stem 22 is in a position such that valve disk 21 does not close the connecting ducts 8 between piston work chamber 5 and diaphragm work chamber 9.

If, however, diaphragm 1 goes outside the intended operating zone by a certain amount, for example 20% of the normal diaphragm stroke, toward the delivery chamber 4, hence occupying in its pressure stroke end position a limit position exceeding the normal position, there will result a position per FIG. 4, in which valve disk 21 has closed the connecting duct or ducts 8 between piston work chamber 5 and diaphragm work chamber 9. This results in a purely hydraulic diaphragm path limitation in the pressure stroke limit position, so that diaphragm 1 cannot be deformed further in the direction of the delivery chamber 4 and is reliably secured against overexpansion. The excess hydraulic fluid present in piston work chamber 5 is forced back into reservoir 7 via the pressure-limiting valve 27 and via the ducts 33, 34.

For the suction stroke, the initially described process then repeats by means of the displacement of piston 6 occurring to the right, until in the suction stroke end position diaphragm 1 applies against the support face 10, 10', 10'' and takes support there fully mechanically.

In the case of malfunction represented in FIG. 6 merely for the sake of the example, slide valve 19 has jammed in its bore, for example due to dirt, in such a way that it remains continuously in its open position. This means that its peripheral groove 30 is continually in connection with duct 18, so that the leakage makeup connection between reservoir 7 and hydraulic chamber 5, 9 is continuously open—via ducts 17, 18, 8 and the sniffing valve 16. Although uncontrolled sniffing in of hydraulic fluid into chamber 5, 9 is then possible, membrane damage is reliably prevented due to the described arrangement. This is achieved with the second control valve 20, whose valve disk 21 closes the connecting ducts 8 during the next pressure stroke of diaphragm 1 in the pressure stroke limit position thereof, thus resulting in the hydraulic diaphragm path limitation in the pressure stroke limit position. In this case also, the excess hydraulic fluid is discharged from the piston work chamber 5 via the pressure-limiting valve 27 into reservoir 7. The described malfunction can be detected easily and in good time on the basis of the intensified response of the pressure-limiting valve 27 as well as the decreased pump output, so that the trouble can be remedied at once.

In the modified form of realization of the diaphragm pump according to FIG. 7, there is provided in the pump housing 2 a venting bore 25 which extends from the geodetically highest point of diaphragm work chamber 9 to the combined pressure-limiting and gas discharge valve 27. At the valve-side end the venting bore 25 has a check valve 26. The latter is set so as to permit the desired venting of the diaphragm work chamber 9, i.e. to permit a control from the diaphragm work chamber 9 to the gas discharge valve 27. On the other hand, check valve 26 prevents a by-pass flow from the piston work chamber 5 to the diaphragm work chamber 9 when the second control valve 20 is closed.

The further modified form of realization per FIG. 8 represents a simplified design as compared with the previously described design, inasmuch as the second control valve 20 consists merely of the valve disk 21 and hence does not have a valve stem that is separately guided in slide valve 19 and is under the action of a compression spring. The valve disk 21 is firmly connected with the piston-side end of slide valve 19 and is arranged or dimensioned so that, in the pressure stroke end position of diaphragm 1 corresponding to a limit position, it too will close the connecting ducts 8 between piston work chamber 5 and diaphragm work chamber 9. The respective diaphragm position is sensed only by the slide valve 19 under the action of compression spring 23, or respectively by the support plate 31 thereof, the same advantageous effects being obtained as in the embodiments described before.

In the suction stroke end position of diaphragm 1, the leakage makeup of the hydraulic chamber 5, 9 is achieved via an axial bore 35 provided in slide valve 19, which bore leads on the one hand through valve disk 21 into the piston work chamber 5 and on the other hand communicates via a radially extending tubing section 36 with duct 18 or respectively with the sniffing valve 16.

With respect to features of the invention not specifically explained in greater detail above, reference is made expressly to the drawing as well as to the claims.

We claim:

1. Hydraulically driven diaphragm pump with a diaphragm clamped on the edge between a pump body and a pump cover, which diaphragm separates a delivery chamber from a hydraulic chamber, the hydraulic chamber being subdivided into a diaphragm work chamber and a piston work chamber connected therewith via at least one connecting duct, a hydraulic diaphragm drive in the form of an oscillating displacement piston movable in the pump body between a reservoir for the hydraulic fluid and the piston work chamber, and with a diaphragm position-controlled leakage makeup device which comprises a control valve with a control, slide displaceably guided in the zone of the connecting duct between said diaphragm work chamber and said piston work chamber, which slide opens a connection from the reservoir to the piston work chamber in or beyond the suction stroke end position of the diaphragm, characterized in that the control slide (19) of the leakage makeup device is provided at its two ends with devices (31; 20) for stroke path limitation of the diaphragm (1) clamped freely swinging, in such a way that at its diaphragm-side end the control slide (19) has a support plate (31) which is designed so that together with the associated pump body face (10) of the diaphragm work chamber (9) it forms a virtually gap-free mechanical support face (10, 10', 10''), adapted to the natural diaphragm geometry, for the diaphragm (1) in the suction stroke end position thereof, and that the control slide (19) has at its piston-side end a second control valve (20) with a valve element (21) which in or beyond the pressure stroke end position of the diaphragm (1) interrupts the hydraulic connection from the piston work chamber (5) to the diaphragm work chamber (9).

2. Diaphragm pump according to claim 1, characterized in that the mechanical support face (10, 10', 10'') for the diaphragm (1) is made bore-free in the suction stroke end position thereof.

3. Diaphragm pump according to claim 1, characterized in that the second control valve (20) is a disk valve whose valve element designed as valve disk (21) closes the connecting duct or ducts (8) in the pressure stroke limit position of the diaphragm (1).

4. Diaphragm pump according to claim 1, characterized in that the valve element (21) of the second control valve (20) is fastened to one end of a valve stem (22) which is slidably guided in the control slide (19) of the first control valve, coaxially thereto, and by its other end applies against the diaphragm (1) under spring force, so that it senses the diaphragm (1) on the entire diaphragm stroke.

5. Diaphragm pump according to claim 4, characterized in that the control slide (19) of the first control valve is tensioned in the direction of the diaphragm (1) by a spring (23) which is stronger than the spring (24) tensioning the valve stem (22) of the second control valve (20).

6. Diaphragm pump according to claim 5, characterized in that the spring (24) tensioning the valve stem (22) of the second control valve (20) is supported on the control slide (19).

7. Diaphragm pump according to claim 1, characterized in that the control slide (19) has at its piston-side end a stop (29) which limits the displacement path of the control slide (19) in the direction of the diaphragm pressure stroke.

* * * * *